United States Patent [19]

Haböck

[11] Patent Number: 4,540,091

[45] Date of Patent: Sep. 10, 1985

[54] FOIL PACKAGE FOR PAPER HANDKERCHIEFS OR TISSUES

[75] Inventor: Wilhelm Haböck, Altmünster, Austria

[73] Assignee: Papierfabrik Laakirchen Aktiengesellschaft, Laakirchen, Austria

[21] Appl. No.: 513,363

[22] Filed: Jul. 13, 1983

[30] Foreign Application Priority Data

Jun. 1, 1983 [AT] Austria ..... 2013/83

[51] Int. Cl.[3] ..... B65D 75/58; B65D 83/00

[52] U.S. Cl. ..... 206/494; 206/37; 206/233; 221/48; 221/63

[58] Field of Search ..... 206/494, 449, 233, 37, 206/38; 229/17 RS; 221/63, 48

[56] References Cited

U.S. PATENT DOCUMENTS

| | | | |
|---|---|---|---|
| 2,345,309 | 3/1944 | Wensel, Jr. | 206/37 |
| 2,519,261 | 8/1950 | Lorrance | 206/494 |
| 2,573,309 | 10/1951 | Chipkevich | 221/63 |
| 3,193,137 | 7/1965 | McCarthy et al. | 221/63 |
| 3,239,097 | 3/1966 | Bates et al. | 221/48 |
| 3,325,003 | 6/1967 | Bilezerian | 206/494 |

FOREIGN PATENT DOCUMENTS

| | | |
|---|---|---|
| 30601 | 6/1981 | European Pat. Off. . |
| 2136972 | 2/1973 | Fed. Rep. of Germany . |
| 2338907 | 2/1974 | Fed. Rep. of Germany . |

*Primary Examiner*—William T. Dixson, Jr.
*Attorney, Agent, or Firm*—Kurt Kelman

[57] ABSTRACT

A package of folded paper handkerchiefs comprises a foil enveloping the stack of handkerchiefs. The enveloping foil has adjoining end segments extending from the two opposite wide sides to one of the two elongate narrow sides of the foil. The end segments overlap on the one elongate narrow side to form a flap and they are connected to each other along the short end edges of this narrow side. The flap has a convex rim centrally between the connections at the end segments whereby the flap may be lifted off the other end segment to form a dispensing opening for withdrawal of the handkerchiefs from the package between the connections.

5 Claims, 2 Drawing Figures

FOIL PACKAGE FOR PAPER HANDKERCHIEFS OR TISSUES

Figure 1:
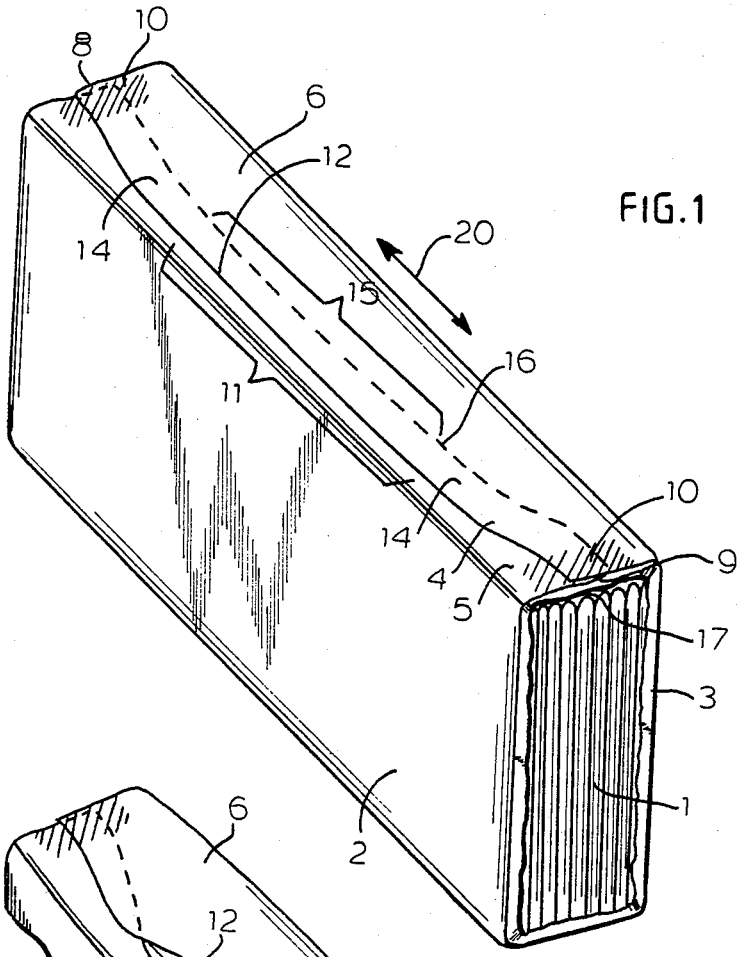

The invention relates to a miniature sheeting package for paper handkerchiefs or tissues in which a small number of folded handkerchiefs, lying close to one another, are piled into a stack, and wherein the stack is surrounded on all sides by a sheeting folded over the stack, one end segment of the sheeting overlapping an opposite end segment thereof on one of the longitudinal narrow sides of the package and the overlapping end segment of the sheeting being upwardly displaceable from the underlying end segment to form an opening for withdrawing the handkerchiefs from the package.

A miniature sheeting package of the aforedescribed type is known, in which the sheeting end segments overlapping one another are formed in the shape of freely movable flaps separated from the short edges of the longitudinally extending narrow sides by cuts extending transversely to the longitudinal direction of the narrow side of the package to enable them to be easily folded out, so that free access is obtained to the stacked handkerchiefs lying close to one another in the package. For the closing of this known miniature sheeting package for handkerchiefs there is provided an adhesive tape, which is disposed on the overlapping flap, and which is successively formed with a zone coated with adhesive material and a gripping zone free of the adhesive material, and wherein the zone coated with the adhesive material is provided so as to keep the overlapping flap of the sheeting down, by pressing it against the free edge of the wide side of the package which adjoins the flap, and thereby closing the opening of the package which serves for withdrawal of the handkerchiefs from the package. The uncoated zone of the adhesive tape is formed as a grip, so as to be able to remove the adhesive tape again from the wide side of the package, and so as to release the opening for withdrawal of the handkerchiefs, by folding out of overlapping flap of the sheeting and the inwardly disposed sheeting flap lying therebelow. In this known miniature sheeting package for handkerchiefs, it is not only disadvantageous that a higher expense is involved by the necessity to utilize an adhesive tape for closure of the opening, which serves for withdrawal of the handkerchiefs but it is further disadvantageous, that the sheeting flaps have to be relatively stiff, so as to be able to obtain the desired function, as a result of which stamping or similar measures have to be provided, which increase the manufacturing cost; furthermore, over longer time spans, the holding force of a connection obtained by a self-adhering tape is rather small, and in the presence of dust or dirt, the adhesive force of a self-adhering tape is rapidly reduced, so that an adequately holding closure of the opening serving for withdrawal of the handkerchiefs can no longer be ensured.

It is an object of the present invention to devise a miniature sheeting packaging of the initially-described kind whose construction produces a self-actuated closure for withdrawal of the handkerchiefs, after the handkerchiefs have been withdrawn, so that this self-actuating closure of the package provides a good protection of the goods still remaining in the package, following withdrawal of the handkerchiefs therefrom, against any disadvantageous influences acting from the exterior, such as contamination.

The miniature sheeting package of the invention is characterized by the overlapping end segments of the package-forming sheeting secured to one another, preferably by welding, at the two short edges of one of the longitudinally extending narrow sides of the package, the overlapping end segment of the sheeting having a convexly extending rim in a center region thereof between the securement locations.

Such as package meets the above-described object very well, wherein it must be considered a particular advantage that the package can be manufactured more simply than known packages, as the end segments of the sheeting do not require any particular stiffening treatment and the adhesive tape may be dispensed with. This package also requires no special manipulation for closure of the package, following withdrawal of a handkerchief therefrom, as the opening serving for withdrawal of the handkerchiefs closes by itself, as a result of the tension exerted by the contents of the package on the sheeting envelope, and the closure is not impaired even by opening the package several times or by dust or contamination, while all these factors impair the functioning of the adhesive tape provided in the known packages. Consequently, the miniature sheeting package of the invention has clearly improved utility over the known package.

In a preferred embodiment the overlapping sheeting end segment is connected with the underlying sheeting end segment by spot welding to provide an easily releasable original closure. This embodiment offers the advantage that it is immediately recognizable from the state of such a package whether it has already been opened or not, and has the further advantage that the original closure formed by spot welding can be opened without any problems and the first withdrawal of a handkerchief from the originally closed package poses no difficulty. An original closure formed in this manner further does not cause any increased expense either during manufacture of the miniature sheeting package, and this welding can be accomplished without any difficulties during the assembly of the sheeting.

A particularly simple manipulation during opening of the package, for the purpose of withdrawing a handkerchief, an easy withdrawal of the handkerchief from the package and a good self-actuated closure of the opening serving for withdrawal of the handkerchief, following withdrawal thereof, is obtained in an embodiment in which underlying end segment includes a concavely-extending rim in a center region thereof between the securement points along the short edges of the longitudinal narrow side of the package. Here, the easy withdrawal of hankerchiefs from the package is particularly facilitated and the manufacture is simplified if the convexly-extending rim of the overlapping end segment of the sheeting, and the concavely-extending rim of the underlying end segment of the sheeting extend approximately parallel to one another. Parallel extension of the rims permits manufacture of both rims by a common cutting process during processing of a length of sheeting material in a very material-saving manner.

For removal of the handkerchief from the package envelope and for obtaining a good tensile effect by the handkerchiefs in the packaging envelope, it is further advantageous if the handkerchiefs disposed in the package face the opening for withdrawal thereof with their longitudinally extending rear folding edge. This may be explained by the fact that, when a handkerchief is gripped at its rear folding edge, no tendency for fanning exists during the removal process, and the handkerchiefs are stable against telescoping into each other at their rear folding edge. Consequently in the very region of the opening in the packaging envelope serving for withdrawal of the handkerchiefs, there is exerted a tensile force effective in the sense of a good closure of the opening which serves for withdrawal of the handkerchiefs. This advantageous effect can be further improved in a preferred embodiment if handkerchiefs disposed in the package consist along their rear folding edge only of superimposed layers extending over and throughout the entire length of the rear folding edge.

An easily flexible synthetic foil, preferably polyethylene foil, is used for formation of the sheeting envelope. Here it is advantageous to select a sheeting thickness of about 40 to 60 micrometers.

Figure 2:
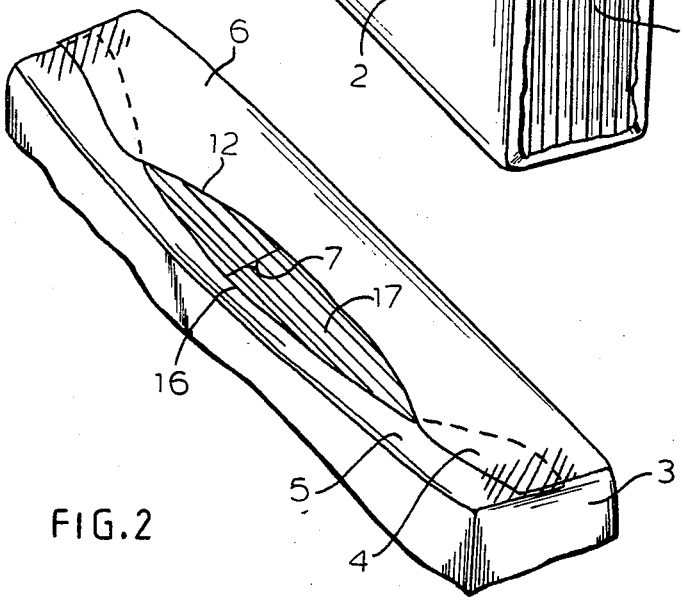

The invention will now be explained by means of an embodiment illustrated in the drawing wherein FIG. 1 shows a view of a miniature sheeting package for handkerchiefs in the originally closed state, and FIG. 2 shows a fragmentary view of such a package in an open state for withdrawal of the handkerchiefs.

In the illustrated embodiment, a small number, for example 10 folded handkerchiefs 1 are stacked, is an enveloping sheeting surrounding the stack on all sides. A part of this sheeting is shown broken away along the short narrow side 3 of the package, so that the stacked handkerchiefs 1 are visible in FIG. 1. End segment 4 overlaps end segment 5 of the sheeting on the longitudinally extending narrow side 6 of the package.

By lifting of the sheeting end segment 4 from the sheeting end segment 5, a withdrawal opening 7 can be formed, as can be seen from FIG. 2, from which the handkerchiefs 1 can be withdrawn from the sheeting envelope.

The overlapping sheeting end segments 4 and 5 are secured to one another along the short edges 8 and 9 of the longitudinally extending narrow side 6 of the package, as has been shown in the drawing by the hatched surfaces 10. Such a connection can be obtained very simply by welding. The overlapping sheeting end segment 4 includes, within a center region 11 between these connections, a convexly-extending rim 12. This rim permits a simple gripping of this sheeting end segment 4 and an easy opening of the opening 7 serving for withdrawal of the handkerchiefs, through which the handkerchiefs 1 can be withdrawn from the sheeting envelope. Furthermore, this convex extension of the rim 12, provides a good cover for the withdrawal opening 7, so that the handkerchiefs are well protected in the sheeting envelope against any contamination. Advantageous is also an original closure in the form of welding points 14, by means of which the sheeting end segment 4 is connected with the sheeting end segment 5 lying therebelow.

The underlying sheeting end segment 5 includes in the illustrated embodiment in its center region 15, which lies between the connections 10 at the short edges 8, 9 for the longitudinally extending narrow side 6 of the package, a concavely extending rim 16. Such a concavely-extending rim 16 can optionally be manufactured in one operating step with the convexly-extending rim 12 of the sheeting end segment 4 and, consequently, it is possible to operate in an economical manner without any cutting losses if a length of sheeting material is worked on, in which there are formed successively cuts for the formation of sheeting envelopes of the package. In such an operation, as can be seen from FIG. 1, the rims 12, 16 of the sheeting segments 4, 5 extend parallel to one another. Such a parallel extension of the rims 12, 16 is also advantageous with respect to an easy withdrawability of the handkerchiefs 1 from the opening 7.

Both for the withdrawal of the handkerchiefs 1 from the sheeting envelope, as well as for the self-actuating closure of the opening 7 following withdrawal, it is advantageous if the handkerchiefs 1 disposed in the packaging face with their longitudinally extending rear folding edge 17 the withdrawal opening 7. The handkerchiefs 1 can be easily gripped at their rear folding edge 17, and withdrawn through the withdrawal opening 7, without any problems and, as a result of the fact that the handkerchiefs 1, in the region of the rear folding edge 17, have a certain stability with respect to being telescoped into one another along the running direction of the rear folding edge, a good tensile effect is obtained, which is exerted by the stack of handkerchiefs 1 upon the sheeting envelope in the region of the double arrow 20, and this tensile effect results in a self-actuating closure of the withdrawal opening 7, as, by exerting a tensile action upon the ends of the sheeting end segments 4, 5, these sheeting segments are made to lie close to one another, so that the withdrawal opening 7 is well closed thereby. Here it is particularly advantageous if the handkerchiefs 1 disposed in the package are so folded that they consist only of superimposed layers on their rear folding edge 17, the layers extending over the entire length of the rear folding edge. Such a folding, known per se, can, for example, be made by folding one handkerchief initially into one half, and by subsequently performing two consecutive folding processes about respective geometric axes, which extend parallel to one another, and which are at right angles to the geometric axis of the first folding. But other foldings are also conceivable.

I claim:

1. A miniature parallelepiped package of paper handkerchiefs comprising a stack of a small number of folded handkerchiefs and a length of a foil enveloping the stack of handkerchiefs, the enveloping foil having two opposite wide sides, two opposite short narrow sides and two opposite elongate narrow sides having straight short end edges, the enveloping foil having adjoining end segments extending from the wide sides to one of the elongate narrow sides and one of the end segments overlapping the other end segment on the one elongate narrow side to form a flap, the end segments of the foil being connected to each other along the short end edges of the one elongate narrow side and the flap having a convex rim centrally between the connections of the end segments whereby the flap may be lifted off the other end segment to form a dispensing opening for withdrawal of the handkerchiefs from the package between the connections.

2. The miniature package of claim 1, wherein the end segments of the foil are releasably spot-welded to each other along the convex rim.

3. The miniature package of claim 1, wherein the other end segment of the foil has a concave rim centrally between the connections of the end segments.

4. The miniature package of claim 3, wherein the convex and concave rims of the end segments of the foil extend approximately parallel to each other.

5. The miniature package of claim 1, wherein each one of the folded handkerchiefs has a rear folding edge extending longitudinally between the short end edges and the handkerchiefs are stacked so that the rear folding edges face the one elongate narrow side of the foil for withdrawal of the handkerchiefs through the dispensing opening by the rear folding edges.

* * * * *